US005152841A

United States Patent [19]

Medler et al.

[11] Patent Number: 5,152,841

[45] Date of Patent: Oct. 6, 1992

[54] METHOD FOR AUTOMATIC SEQUENTIAL COATING OF WORKPIECES

[75] Inventors: Eberhard Medler, Esseggerstr.; Siefried Phillipi, Klaiberweg; Kurt Vetter, Rechbergweg; Ludwig Freudenreich, Ostrasse, all of Fed. Rep. of Germany; Othmar Lippuner, Quartierstr., Switzerland

[73] Assignees: Behr Industrieanlagen GmbH & Co.; Daimler-Benz AG, Fed. Rep. of Germany

[21] Appl. No.: 186,179

[22] Filed: Apr. 26, 1988

[30] Foreign Application Priority Data

Apr. 27, 1987 [DE] Fed. Rep. of Germany ..... 3713999

[51] Int. Cl.[5] ..... B05C 11/00

[52] U.S. Cl. ..... 118/704; 118/696; 118/300; 239/71; 239/73; 222/504

[58] Field of Search ..... 118/696, 704, 300; D23/123; 239/71, 73; 222/504

[56] References Cited

U.S. PATENT DOCUMENTS 1,876,644 9/1932 Downs ..... 239/71
3,481,542 12/1969 Huber ..... 239/71
3,916,032 10/1975 Conner ..... 427/8
4,483,480 11/1984 Yasuhara ..... 239/73
4,546,724 10/1985 Kiryu ..... 118/697
4,653,696 3/1987 Rath ..... 239/73
4,662,564 5/1987 Okuda ..... 239/73

*Primary Examiner*—Shrive Beck
*Assistant Examiner*—Vi Duong Dang
*Attorney, Agent, or Firm*—Reising, Ethington, Barnard, Perry & Milton

[57] ABSTRACT

A method and apparatus for controlling the sequential coating of motor-vehicle bodies using a preprogrammed painter-robot is provided. As a result of wear, the signal/response delay times of valves and other control elements deviate from the information stored in the program. According to the subject invention, the actual signal/response delay time is measured and compared with the stored information stored in the program. In the event of unacceptable deviations in the actual verses stored signal/response delay times, the actuating times controlled by the program are changed in response thereto, and signals warning of excessive actual delay time are given.

5 Claims, 2 Drawing Sheets

METHOD FOR AUTOMATIC SEQUENTIAL COATING OF WORKPIECES

TECHNICAL FIELD

The subject invention relates to a method for sequentially coating workpieces using a painter robot spraying device controlled by a stored operating program.

BACKGROUND ART

The prior art has taught the use of printer-robot spraying devices controlled by a processing program for sequentially coating workpieces, such as the unfinished bodies of motor-vehicles. The processing program controlling the painter-robot contains control-information responsive to a plurality of individual paint impact points disposed on the workpiece which are approached by the painter-robot during the coating process. The control-information includes not only movement-control data but also information regarding the amount of paint required and, if air-operated spray-guns are used, information regarding the quantities of atomizing air and controlling air required. Additionally, information regarding specific signal/response delay-times of the various control elements, e.g., paint flow valves, is stored so that the process program may control the switching on and off of the spray-gun paint needle valve and also the particular device for metering the quantity of paint required. In this manner, the signal/response delay-times for opening and closing the paint needle-valve and for the switching times of other paint flow valves are initially adjusted to accurately maintain the program control signals ready for instantaneous change in response to the operating conditions during movement of the robot relative to the predetermined locations on the workpiece. In other words, because of the unavoidable signal/response time delays, switch-on commands must be given before the painter-robot reaches a particular paint impact point. Similarly, switch-off commands must be given when the painter-robot is still at a location which is to be coated.

With any given response behavior of the spraying device, the signal/response time delay information required for the program can be easily determined. However, the delay information stored in the process program no longer agrees with the actual conditions if the response behavior of the spraying device changes in the course of time. These response behavior changes are often unavoidable for various reasons, e.g., changes in friction or wear of the moving parts in the spraying device, a replaced spraying device, parts changes, etc. For these reasons, the quality of the coating applied by the prior art spraying devices has been impaired over the course of time which meant that the signal/response delay times had to be readjusted and reprogrammed by tedious manual operations.

For these reasons, similar problems may also arise in the paint feed lines running to the spraying device. These paint feed lines usually contain a feed pump which direct the paint through a return-circuit bridging the pump when the spraying device is switched off so that, when the paint needle-valve in the spraying device is opened, the required pressure is immediately available. The return-circuit bridging the pump includes a flow control valve which opens automatically when the paint needle-valve closes and closes when the paint needle-valve opens. It has hitherto been customary to use a pressure relief valve for this purpose. In order to avoid excessive or deficient pressure in the paint feed lines, it was previously desirable to switch the flow control valve in the return circuit which separate individual signals at times accurately matching the opening and closing of the paint needle-valve. However, the adjusted switching times for the return circuit would not correspond to the actual conditions if ever the response behavior of the spraying device were to change.

SUMMARY OF THE INVENTION AND ADVANTAGES

The subject invention provides a method for automatically coating workpieces using a painter-robot controlled by stored operating program. The subject method comprises the steps of producing at least one switching signal controlling the paint flow to the painter-robot at predetermined times in response to a stored predetermined delay time between the production of the switching signal and the response of the paint flow and the relative movements between the painter-robot and workpiece. The method is characterized by including the steps of measuring the actual delay time between the production of the switching signal and the response of the paint flow during the coating operation, comparing the actual delay time with the stored delay time, and replacing the stored delay time in the operating program with the actual delay time in the event the difference between the actual delay time and the stored delay time exceeds a predetermined value.

According to a second aspect of the subject invention, a spraying device for automatically and sequentially coating workpieces with a coating fluid and having the controlled movements governed by a stored operating program is provided. The subject invention comprises a flow control valve including a moveable valve-member responsive to a pneumatic control-device for movement between an open terminal position and a closed terminal position. The invention is characterized by the valve including a sensor for producing a signal when the moveable valve-member reaches either the open or the closed terminal position.

The subject invention provides a method and an apparatus for uniformly coating a workpiece to a satisfactory quality which can be ensured even with chronologically varying response behaviors of the control elements in a spraying device.

BRIEF DESCRIPTION OF THE DRAWINGS

Other advantages of the present invention will be readily appreciated as the same becomes better understood by reference to the following detailed description when considered in connection with the accompanying drawings wherein.

DETAILED DESCRIPTION OF THE PREFERRED EMBODIMENT

Figure 1:
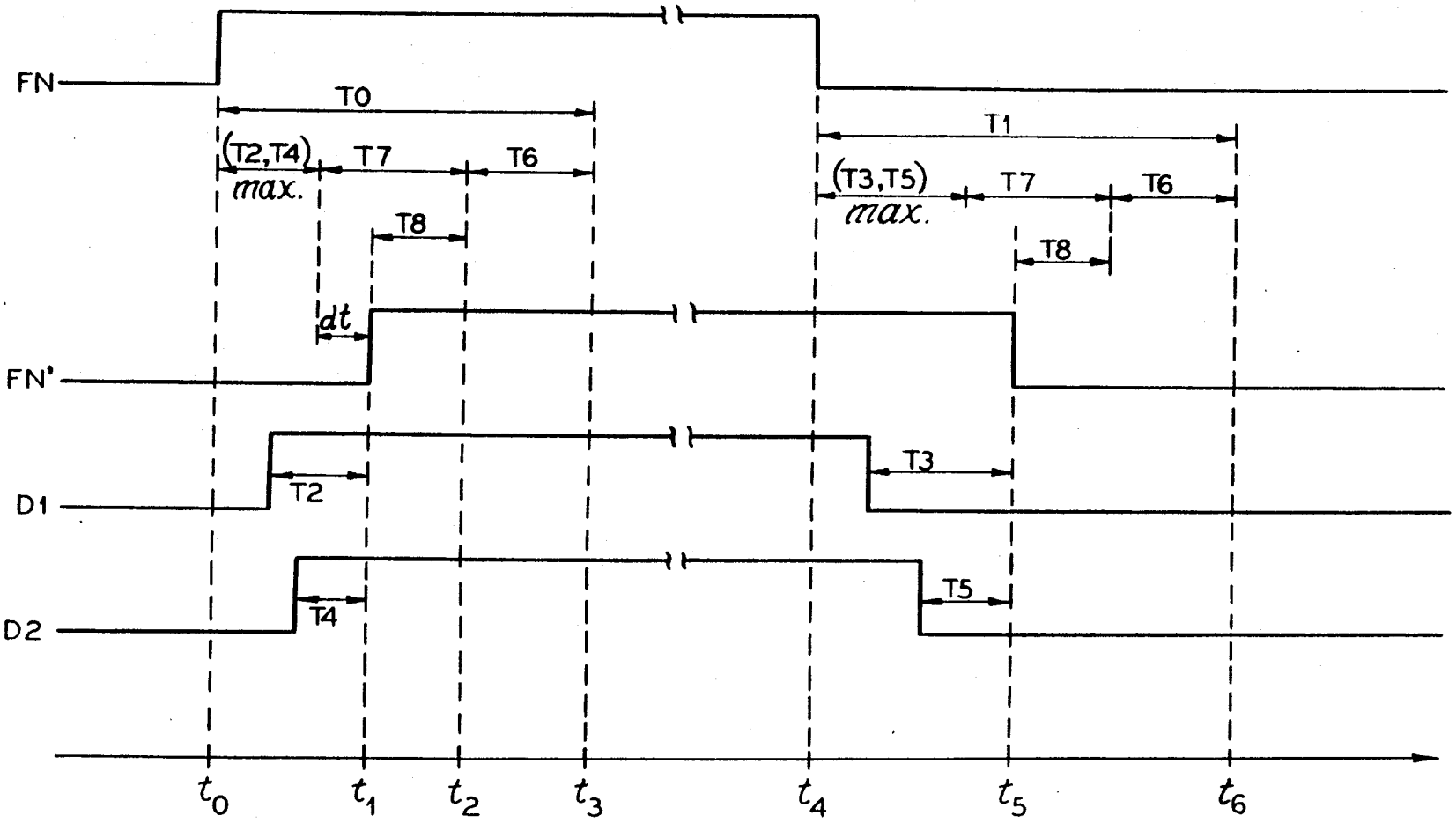
FIG. 1 is a block diagram of the switching times for different control elements in the spraying system.

The block diagram shown in FIG. 1 relates to a system for automatic sequential coating of motor-vehicle bodies using a programmed painter-robot. The spraying device actuated by the robot is to be initially switched on and subsequently switched off by a switching command FN produced by a robot control program at time $t_0$. The switching command FN causes a separate control-unit, e.g. one containing a microprocessor, to deliver, after a preadjusted waiting period ending at time $t_1$, an actual switching-on signal FN' for a paint needle-valve in the spraying device. Because of the unavoidable signal/response delay times resulting from the control elements, e.g., valves in the spraying device, the paint needle-valve will actually open after a certain paint-needle opening time T8 which is monitored and measured. Following the paint needle-valve opening time T8, a report-back signal is produced by the paint needle-valve at time $t_2$ in a manner to be described subsequently. After a paint flight time T6, the paint contacts the body to be coated at time $t_3$. The total time between $t_0$ and $t_3$ is the switching-on time, or lead-time, T0 of the paint needle-valve recorded in the robot program as a process parameter.

A paint needle-valve switching-off time T1, also recorded as a process-parameter, is determined in a manner similar to the determination of the switching-on time T0. The paint needle-valve switching-off time T1 comprises the time beginning from the disappearance of the switching-on command FN at time $t_5$, plus the switching-off delay-time of the paint needle-valve assumed to equal the measured switching-on paint-needle time T8, plus the paint flight time T6. The coating of the body thus comes to an end at time $t_6$.

Also shown in FIG. 1 are the respective switching-on times T2 and T4 and the respective switching-off times T3 and T5 of two flow control valves receiving actuation signals D1 and D2, respectively, from the time-control unit. These two flow-control valves are located in two return circuits of the paint feed lines each bridging a feed pump disposed in a parallel paint feed line. Two parallel paint feed lines are included so that different paint colors may be supplied to the spraying device. The flow control valves and their associated return circuits bridging the feed pump ensure uniform pressure at all times in the paint feed lines both before and after the paint needle-valve opens and closes. If this objective is to be achieved, then the times at which the flow control valves are switched on and off must be matched, or synchronized, accurately with the switching times and the signal/response delay times of the paint needle-valve. These switching times may be determined by appropriate testing.

In the example illustrated in FIG. 1, the flow control valve switching times occur before the paint needle-valve switching times. In other cases, because of peculiar valve designs or line conditions, it may become necessary to switch the flow control valves chronologically after the paint needle-valve.

Over the course of time, a problem may arise as a result of unpreventable changes in friction or wear of the control elements in the spraying device, for example in the actual paint needle-valve opening and closing time T8. If the paint needle-valve opening time T8 becomes shorter or longer than the value used in programming the robot and in adjusting the control-unit, there occur coating defects on the body. Additionally, pressure defects may also occur in the paint feed line system since the flow control valve switching times T2, T3, T4 and T5 are no longer synchronized with the actual opening and closing times T8 of the paint needle-valve.

In solving this problem, a theoretically calculated maximum admissible paint needle-valve opening and closing time T7 is calculated. The length of the maximum admissible opening time T7 must not be exceeded by the actual measured time T8. However, in normal operation the length of T8 is less than that of T7. The paint needle-valve is therefore opened at exactly the correct time $t_2$. The control-unit switches on the paint needle-valve later at a time interval dt corresponding to the difference between the lengths of times T7 and T8, as was the case when use was made of the theoretical paint needle-valve opening time T7.

Now if measuring the actual paint needle-valve opening time T8 shows a change from a previously measured duration, this change is compensated for in the control unit by automatic alteration of the time interval dt.

If, over course of time, the actual measured paint needle-valve opening time T8 increases to such an extent that it can no longer be compensated for by reducing dt, i.e., the interval dt moves toward zero or becomes negative and the paint needle-valve opening time T8 becomes equal to or greater than T7, then the control unit produces an alarm signal, shuts off the paint needle-valve and simultaneously opens the flow-control valves. Before this happens, however, it is also possible to release a warning signal as soon as the measured value of the paint needle-valve opening time T8 approaches a predetermined critical limit.

In the control-unit it may not be desirable to continuously compare the actual measured paint needle-valve opening time T8 directly with the stored theoretical value according to time T7, but first of all to form an average value from a plurality of recent actual measurements of the opening time T8. In this case, the warning or alarm signals are produced only if this average value T8 exceeds the theoretical limit T7.

In the example shown in FIG. 1 of flow control switching times prior to the paint needle-valve switching times, the switching-on time $t_1$ should not occur before the expiration of a time-interval maximum (T2, T4) of the flow control valves. Similarly, upon switching-off, consideration must be given to the maximum possible time-interval (T3, T5) of the flow control valve switching-off time when selecting times $t_4$ and $t_5$.

In the case of flow control valve actuation after paint needle-valve actuation, the compensating time interval dt may directly follow the time at which the switching command FN is produced by the program control, both upon switching on and switching off.

The paint needle-valve opening time T8 and the time-interval dt may be monitored continuously by the operating crew with the aid of a display-screen connected to the control-unit by an interface. Adjustments to the various parameters may also be made through this interface.

The method described in conjunction with FIG. 1, i.e., determining the theoretical opening time T7, requires very little expenditure by the control-unit. Based upon a constant measurement of the actual signal/response delay time of the paint needle-valve, the reporting thereof to the control-unit, and the comparison with a stored normal value, it is also possible to adapt the entire process program, continuously or intermittently, to the actual measured opening time T8. More particularly, it is possible to continuously vary the programmed switching-on time T0, or lead-time, of the paint needle-valve. In other cases it may be better to change, from time to time, only the adjusted switching times for adaptation to the actual measured delay value T8. Combinations of these possibilities are also conceivable.

Figure 2:
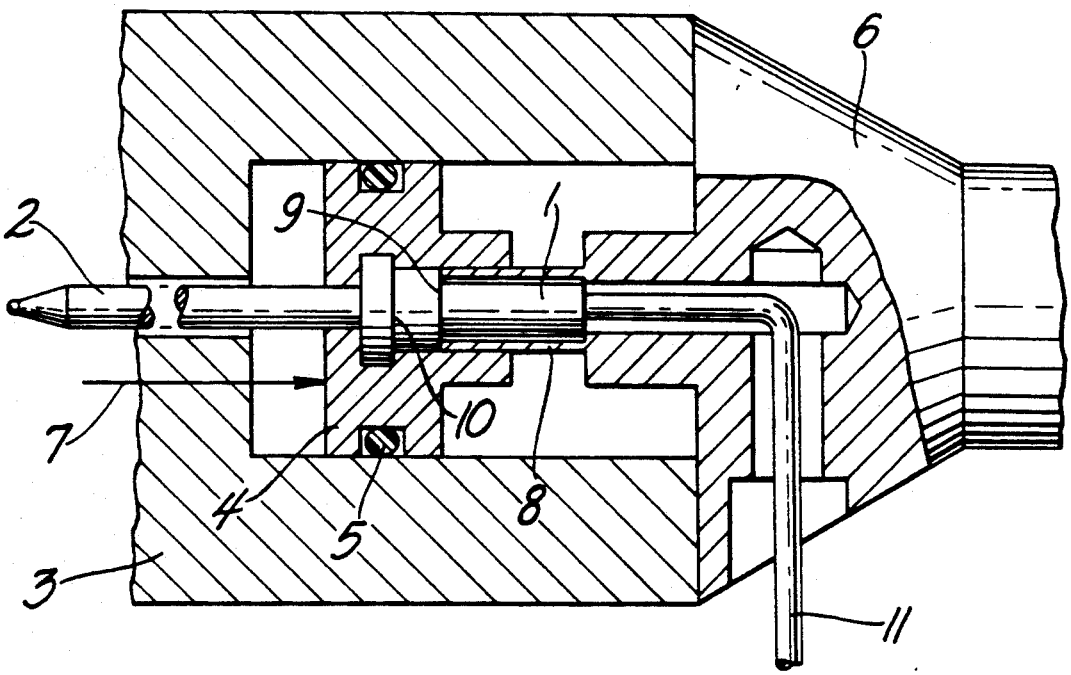
FIG. 2 is a paint needle-valve according to the subject invention having a measurable actuating time.

FIG. 2 is a simplified representation of a portion of a paint needle-valve into which a sensor 1 is incorporated by means of which the actual paint needle-valve opening time T8 can be measured. It will be seen that the rear end (right end as viewed from FIG. 2) of a needle 2 is secured in a piston 4. The piston 4 is axially displaceable in a matching recess in a housing 3. Arranged between the piston 4 and the wall of the recess is an annular seal 5. The forward end (left end as viewed from FIG. 2) of the needle 2 co-operates with a nozzle, not shown, which is opened or closed in response to the axial position of the needle 2. From a neutral position shown wherein the paint needle-valve is closed, the needle 2 is moved axially by applying compressed air to the forward end of piston 4. The pressure of the compressed air may act against the force of a compression spring seated between the rear end of the piston 4 and the surface in the recess of the housing 3, facing the piston 4, formed by a cover part 6. An arrow 7 indicates the line of force created by the compressed air.

Paint needle-valve designs of this kind are well known in the prior art. However, in contrast to the conventional prior art designs, the piston 4 has a central axial bore slidingly receiving a hollow cylindrical projection 8 of the cover part 6. The sensor 1 is disposed in the housing recess, coaxial with needle 2. More specifically, the sensor 1 is a proximity-switch having a sensor surface 9 extending perpendicularly of the central axis and parallel to an end face 10 of the needle 2. The edge of the projection 8 facing the end face 10 may act as a stop for the end face 10 and is generally disposed in the same plane as the sensor surface 9.

The sensor 1 is inserted, e.g., by screwing into the projection 8 in such a manner as to be axially adjustable, and may be replaced after removing the cover part 6. If the needle 2 is moved into its rearward terminal position, i.e., the piston 4 is moved adjacent the rear end of the housing recess, to open the paint needle-valve, the sensor 1 produces an electrical report-back signal via connecting lines 11 passing through openings in the cover part 6, as a result of the end face 10 of needle 2 approaching the sensor surface 9.

The piston 4 is moved past the opening of a compressed-air valve controlled by the switching-on signal FN'. The time delay T8 in actuating the paint needle-valve, measured with the sensor 1, is defined as the period between the production of this switching-on signal at time $t_1$ and the return of the report-back signal at time $t_2$ via the connecting lines 11.

This type of signal/response delay measurement is possible not only with the paint needle-valve, but also in the same or a similar manner with the other control elements in the coating system, and especially with valves of metering devices, compressed-air systems, and the like.

FIG. 1 illustrates only the synchronization of the paint needle-valve with the switching on and off of the flow control valves of the paint feed lines or of the device for metering the quantity of paint. In a program-controlled coating system, for which the subject invention is intended, it may also be desirable to control other elements chronologically in relation to each other. For example, while the paint is being sprayed, paint atomizers require continuously measured amounts of control-air according to the amount of paint used and possibly to other parameters. In the course of the process program, the read-off control commands for adjusting the amount of paint, the amount of air, etc., are released from the robot control system to a parameter control system which in turn controls the regulating or adjusting elements for the relevant parameters of concern. Thus, the program control may be improved if the different lead-times for the various coating parameters are taken into account.

Paint quantity regulators, in particular, respond more quickly to change commands than air-quantity regulators. Therefore, if read-off control commands for paint-quantities and air-quantities are released simultaneously to the relevant regulators, this could result in incorrect spraying conditions, since the correct quantities of air for the quantity of paint adjusted are not obtained immediately. The same may apply to other parameters. For this reason, at least two different transfer signals are produced by the robot control system in the course of the control program. The one signal controlling the adjustment of the more slowly variable parameter, e.g., the air quantity, is released to the parameter control system chronologically earlier than the second signal controlling adjustment of the more quickly variable paint quantity parameter. The parameter control system then transfers the control command more quickly, i.e., chronologically faster, to the relevant regulator. This results in substantially simultaneous adjustment or changing of the coating parameters. The characteristics of the control circuits of the relevant parameters may be optimized by different transfer signals.

The invention has been described in an illustrative manner, and it is to be understood that the terminology which has been used is intended to be in the nature of words of description rather than of limitation.

Obviously, many modifications and variations of the present invention are possible in light of the above teachings. It is, therefore, to be understood that within the scope of the appended claims the invention may be practiced otherwise than as specifically described.

What is claimed is:

1. A spraying device for automatically and sequentially coating workpieces with a coating fluid and having controlled movements governed by a stored operating program, said device comprising: a housing (3) defining a cylindrical bore; a piston (4) axially moveable within said cylindrical bore of said housing (3) and said piston including an axially extending recess; a flow control valve including a valve-member (2) fixed to and moveable with said piston (4) and responsive to a control-device for movement with said piston (4) between an open terminal position and a closed terminal position; said device characterized by including a sensor (1) fixed relative to said housing (3) and having at least a portion said sensor (1) slidingly received in said recess of said piston (4) for producing a signal in response to a predetermined spacing from said valve-member (2) to indicate when said moveable valve-member (2) reaches one of said open and closed terminal positions.

2. A spraying device as set forth in claim 1 further characterized by said sensor (1) including an electrical proximity switch having a sensor-end (9) adjacent a target (10) of said valve-member (2).

3. A spraying device as set forth in claim 2 further characterized by said sensor-end (9) of said proximity switch (1) generally disposed in the plane of a stop-surface for the rear end of the valve-member (2).

4. A spraying device as set forth in either one of claims 2 or 3 further characterized by said sensor (1) relative to said housing (3).

5. A spraying device as set forth in claim 1 further characterized by said sensor (1) being inserted in a hollow cylindrical projection (8) of a cover part (6) of said housing (3), said projection (8) being coaxial with said valve-member (2).

* * * * *